US008558652B2

(12) United States Patent
Arai et al.

(10) Patent No.: US 8,558,652 B2
(45) Date of Patent: Oct. 15, 2013

(54) LAMINATED INDUCTOR AND MANUFACTURING METHOD THEREOF

(75) Inventors: Takayuki Arai, Takasaki (JP); Hitoshi Matsuura, Takasaki (JP); Kenji Otake, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 21 days.

(21) Appl. No.: 13/352,283

(22) Filed: Jan. 17, 2012

(65) Prior Publication Data

US 2013/0038416 A1 Feb. 14, 2013

(30) Foreign Application Priority Data

Aug. 9, 2011 (JP) ..... 2011-173907

(51) Int. Cl.

| | |
|---|---|
| ***H01F 27/02*** | (2006.01) |
| ***H01F 5/00*** | (2006.01) |
| ***H01F 27/30*** | (2006.01) |
| ***H01F 27/28*** | (2006.01) |
| ***H01F 27/24*** | (2006.01) |

(52) U.S. Cl.

USPC ..... 336/83; 336/200; 336/207; 336/223; 336/232; 336/233; 336/234

(58) Field of Classification Search

USPC ..... 336/83, 205, 207, 200, 223, 232, 233, 336/234

See application file for complete search history.

(56) References Cited

U.S. PATENT DOCUMENTS

| | | | | |
|---|---|---|---|---|
| 8,018,313 | B2 * | 9/2011 | Tada et al. | 336/200 |
| 2009/0184794 | A1 * | 7/2009 | Tsuzuki | 336/200 |
| 2010/0289609 | A1 * | 11/2010 | Liao et al. | 336/221 |
| 2011/0133881 | A1 * | 6/2011 | Nakajima et al. | 336/200 |
| 2011/0267167 | A1 * | 11/2011 | Ogawa et al. | 336/221 |

FOREIGN PATENT DOCUMENTS

| | | | |
|---|---|---|---|
| JP | H06-77074 | A | 3/1994 |
| JP | 2002-043163 | A | 2/2002 |
| JP | 2002-164215 | A | 6/2002 |
| JP | 2002-321209 | A | 11/2002 |

* cited by examiner

*Primary Examiner* — Elvin G Enad

*Assistant Examiner* — Kazi Hossain

(74) *Attorney, Agent, or Firm* — Law Office of Katsuhiro Arai

(57) ABSTRACT

Provided is a laminated inductor having a magnetic body, a conductor part covered in a manner directly contacting the magnetic body, and external terminals provided on the outside of the magnetic body and conducting to the conductor part; wherein the magnetic body is a laminate constituted by layers containing soft magnetic alloy grains, and the soft magnetic alloy grain contacting the conductor part is flattened on the conductor part side.

11 Claims, 3 Drawing Sheets

1, 2 Soft magnetic alloy grain, 12 Magnetic body, 13 Conductor part, 100 Partial structure of laminated inductor.

1, 2 Soft magnetic alloy grain, 12 Magnetic body, 13 Conductor part, 100 Partial structure of laminated inductor.

LAMINATED INDUCTOR AND MANUFACTURING METHOD THEREOF

BACKGROUND

1. Field of the Invention

The present invention relates to a laminated inductor and manufacturing method thereof.

2. Description of the Related Art

Traditionally one known method of manufacturing a laminated inductor is printing internal conductor patterns on ceramic green sheets containing ferrite, etc., and then laminating these sheets and baking the laminate.

According to Patent Literature 1, through holes are formed at specified positions in ceramic green sheets made with ferrite powder. Next, on one main surface of the sheets in which through holes have been formed, coil conductor patterns (internal conductor patterns) are printed using conductive paste so that when the sheets are stacked on top of one another and connected via the through holes, a helical coil will be constituted.

Next, the sheets having the through holes and coil conductor patterns are pre-pressed one by one in the laminating direction and then stacked on top of one another in a specified constitution, with ceramic green sheets not having through holes or coil conductor patterns (dummy sheets) placed at the top and bottom. Next, the obtained laminate is pressure-bonded and then baked, after which external electrodes are formed on the end surfaces where the ends of coil are led out, to obtain a laminated inductor.

PATENT LITERATURES

[Patent Literature 1] Japanese Patent Laid-open No. Hei 6-77074

SUMMARY

Electronic components are becoming smaller in recent years and concerns over breakage of coils and other conductor parts are growing as the components become smaller, and therefore component designs that are more resistant to breakage of conductor parts are required. When developing such designs, it is desirable to use as large magnetic grains as possible in order to increase magnetic permeability.

In light of the above, the object of the present invention is to provide a laminated inductor which is constituted in such a way that its conductor part will not break easily even when the component size is reduced, and which preferably also offers high magnetic permeability, as well as a manufacturing method of such laminated inductor.

After studying in earnest, the inventors completed the present invention, the specifics of which are explained below.

The present invention targets a laminated inductor having a magnetic body, a conductor part covered in a manner directly contacting the magnetic body, and external terminals provided on the outside of the magnetic body and conducting to the conductor part. The magnetic body is a laminate constituted by layers containing soft magnetic alloy grains, and soft magnetic alloy grains contacting the conductor part are flattened on the conductor part side.

Preferably, soft magnetic alloy grains positioned on the main surfaces of layers containing soft magnetic alloy grains are flattened on the main surface side.

Further, the soft magnetic alloy grains are preferably made of a Fe—Cr—Si alloy.

More preferably, the soft magnetic alloy grains have an oxide film on their surface.

According to the manufacturing method proposed by the present invention, green sheets containing soft magnetic alloy grains are prepared, the obtained green sheets are rolled and through holes are formed in them, or through holes are formed in the green sheets and then the green sheets are rolled, after which conductor patterns are printed on the rolled green sheets having through holes and then the green sheets having conductor patterns printed on them are stacked on top of one another and pressure-bonded and heat-treated to form a conductor part formed by the conductor-filled through holes and conductor patterns, as well as a magnetic body constituted by soft magnetic alloy grains covering the inside and outside of the conductor part, after which external terminals conducting to the conductor part are formed on the outside of the magnetic body, to obtain a laminated inductor.

According to the present invention, the contact surface between the conductor part such as a coil and the magnetic body is less uneven and therefore a wire breakage failure of the conductor part occurs less often. Since wire breakage failures are expected to decrease due to structural factors, relatively large soft magnetic alloy grains can be used and consequently magnetic permeability can be improved.

According to a favorable embodiment of the present invention, layers containing soft magnetic alloy grains contact each other via their smooth surfaces even in areas where there is no conductor part and consequently soft magnetic alloy grains are densely packed, which is expected to improve magnetic permeability further.

According to another favorable embodiment of the present invention, soft magnetic alloy grains are made of a Fe—Cr—Si alloy and undergo deformation relatively easily and for this reason the aforementioned flattening can be caused easily in an efficient manner.

According to yet another favorable embodiment of the present invention, the action of oxide film present on the surface of soft magnetic alloy grains ensures insulation property of the magnetic body.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
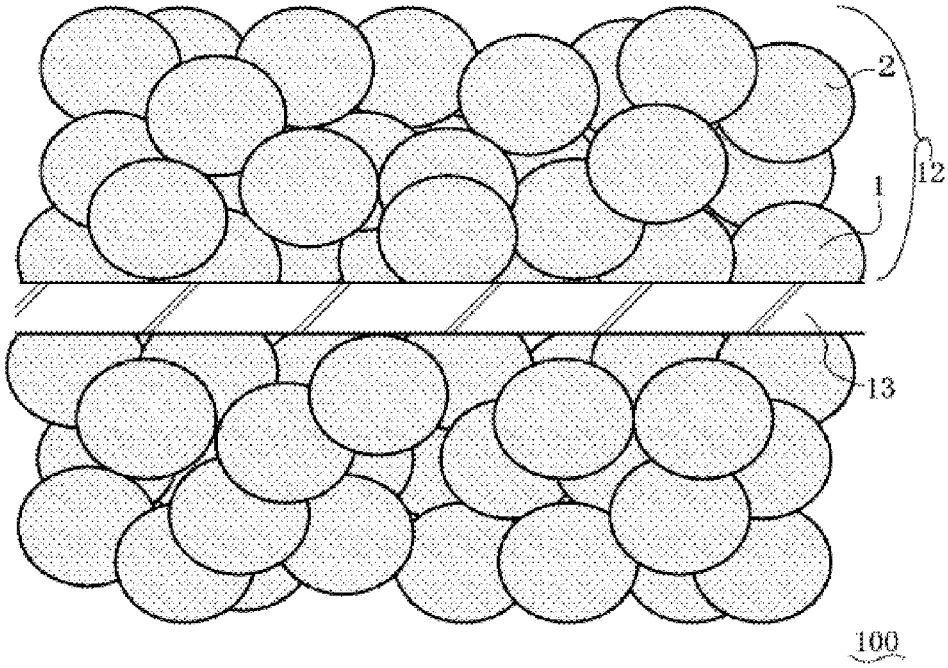
FIG. 1 is a schematic section view of a partial structure near a conductor part of a laminated inductor conforming to the present invention.

1, 2 - - - Soft magnetic alloy grain
10 - - - Laminated inductor
11 - - - Main component body
12 - - - Magnetic body
13 - - - Conductor part
14, 15 - - - External terminal
100, 200 - - - Partial structure of laminated inductor

DETAILED DESCRIPTION OF EMBODIMENTS

The present invention is explained in detail below by referring to the drawings as deemed appropriate. Note, however, that the present invention is not at all limited to the illustrated embodiments and that, because characteristic parts of the invention may be illustrated with an emphasis in the drawings, the scale of each part of the drawings is not necessarily accurate.

The laminated inductor, which is the target of the present invention, is structured in such a way that a majority of the conductor part is buried in the magnetic material (magnetic body). The conductor part in the magnetic body is formed by, for example, printing virtually circular, semicircular or other conductor patterns on green sheets by means of screen printing, etc., and then filling through holes with a conductor, followed by stacking of the aforementioned sheets on top of one another. The green sheets on which the conductor patterns are printed contain the magnetic material and have through holes at specified positions. The conductor part may be a helical coil as illustrated, spiral coil, meandering conductive wire, or straight conductive wire, among other shapes.

FIG. 1 is a schematic section view of a partial structure near the conductor part of a laminated inductor conforming to the present invention. In this partial structure 100 of the laminated inductor, many soft magnetic alloy grains 1, 2 are put together to constitute a magnetic body 12 of a specified shape. Individual soft magnetic alloy grains 1, 2 preferably have an oxide film formed over their entire periphery, as this oxide film ensures insulation property of the magnetic body 12. Oxide film is not illustrated in each drawing. Soft magnetic alloy grains 1, 2 generally constitute this magnetic body 12 of a specified shape by means of bonding of oxide films formed on adjacent soft magnetic alloy grains 1, 2. It is also possible for adjacent soft magnetic alloy grains 1, 2 to partially bond via their metal parts. Also near the conductor part 13, the soft magnetic alloy grain 1 and conductor part 13 are contacting each other primarily via the oxide film. If soft magnetic alloy grains 1, 2 are made of a Fe-M-Si alloy (where M is a metal which is oxidized more easily than iron), then the oxide film has been confirmed to contain at least $Fe_3O_4$ which is a magnetic body, and $Fe_2O_3$ and MOx which are non-magnetic bodies (x is a value determined according to the oxidation number of metal M).

Presence of the bond between oxide films can be clearly determined by, for example, taking a scanning electron microscope (SEM) image, etc., magnified by approx. 3,000 times and visually confirming that the oxide films on adjacent soft magnetic alloy grains 1, 2 have the same phase. Presence of such bond between oxide films improves the mechanical strength and insulation property of the laminated inductor. Desirably, bonding between oxide films on adjacent soft magnetic alloy grains 1, 2 is present throughout the laminated inductor, but as long as such bonding is present partially, mechanical strength and insulation property will improve correspondingly, and such mode is also considered an embodiment of the present invention.

Similarly, presence of the bond between metal parts of soft magnetic alloy grains 1, 2 (metal bonding) can be clearly determined by, for example, taking a scanning electron microscope (SEM) image, etc., magnified by approx. 3,000 times and visually confirming that adjacent soft magnetic alloy grains 1, 2 have the same phase and bonding points. Presence of such bonding between metal parts of soft magnetic alloy grains 1, 2 improves magnetic permeability further.

It should be noted that a mode where adjacent soft magnetic alloy grains are simply making physical contact or positioned close to each other and neither bonding between oxide films nor bonding between metal grains is present, may exist partially.

Figure 2:
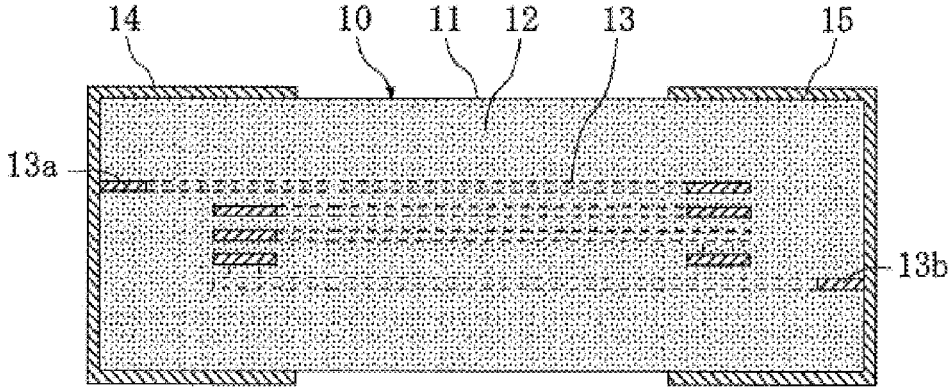
FIG. 2 is a schematic section view of a laminated inductor.

FIG. 2 is a schematic section view of a laminated inductor. A laminated inductor 10 has a magnetic body 12 and a conductor part 13 provided in a manner buried in the magnetic body 12. For the conductors constituting the conductor part 13, any metal normally used for laminated inductors can be used as deemed appropriate, examples of which include, but are not limited to, silver and silver alloy. Both ends of the conductor part 13 are respectively led out, via lead conductors 13*a*, 13*b*, to the opposing end faces (outside) of the outer surfaces of the laminate which provides a main component body 11 constituting the magnetic body 12, and connected to external terminals 14, 15.

To constitute the conductor part 13, typically paste, etc., containing conductive grains is printed on green sheets to form conductor patterns. After the sheets have been laminated, layer interfaces derived from the surfaces of respective green sheet layers remain in the laminated inductor which is obtained after heat treatment, and these layer interfaces can be observed by taking an electron microscope image, etc., of a section of the laminated inductor, for example. Furthermore, parts derived from green sheet surfaces on which conductor patterns are printed to form the conductor part, can be specified by observing a section of the laminated inductor with an electron microscope, etc.

As shown in FIG. 1, the soft magnetic alloy grain 1 is flattened in an area contacting the conductor part 13 under the present invention. To be specific, the soft magnetic alloy grain 1 contacting the conductor part 13 is flattened on its conductor part side. Under the present invention, the conductor part 13 side of the soft magnetic alloy grain 1 need not constitute a geometrical plane, and it is sufficient that, for example, the soft magnetic alloy grain 1 contacting the conductor part 13 deforms and becomes flatter on the side contacting the conductor part 13 than the soft magnetic alloy grain 2 located away from the conductor part 13. Here, "deform" represents a wide concept without limitation, referring to a grain being crushed, rolled and expanded, or even partially shaved off, and consequently changing its shape. For example, more than half of the soft magnetic alloy grains contacting the conductor part 13 undergo methodical or systematic deformation (non-random deformation) to be flattened so that the flattened surfaces can define substantially a common plane, as compared with the shapes of soft magnetic alloy grains located away from the conductor part. Since the gains are constituted by soft magnetic alloy, not ceramics, they can be deformed and flattened as described above by any of the methods disclosed herein or any methods equivalent thereto.

According to the present invention, the contact interface between the conductor part 13 and magnetic body 12 becomes smooth and less uneven, and therefore a wire breakage failure of the conductor part 13 occurs less often. Furthermore, DC resistance (Rdc) is expected to be kept low. Since reduction of wire breakage failures due to the action of the present invention is expected to basically be independent of the size of soft magnetic alloy grains 1, 2, relatively large soft magnetic alloy grains 1, 2 can be used and consequently magnetic permeability can be improved.

Preferably, in addition to soft magnetic alloy grains in areas contacting the conductor part 13, those present on the laminated surfaces in each laminated structure in the laminated inductor are also flat. In other words, soft magnetic alloy grains positioned on both main surfaces of each layer in the laminate constituting the magnetic body 12 are preferably flattened on their main surface side. The main surfaces of the layer are two opposing planes running perpendicular to the thickness direction of the layer. Soft magnetic alloy grains constituting the main surfaces of the layer are flattened in areas contacting the outer side of the layer, and because of this the layer interfaces become smoother and consequently soft magnetic alloy grains are densely packed, which is expected to improve magnetic permeability.

A typical manufacturing method of a laminated inductor 10 according to the present invention is explained below. To manufacture a laminated inductor 10, first a doctor blade, die-coater or other coating machine is used to coat a prepared magnetic paste (slurry) onto the surface of a base film made of resin, etc. The coated film is dried with a hot-air dryer or other dryer to obtain a green sheet. The magnetic paste contains soft magnetic alloy grains 1, 2 and typically a polymer resin acting as binder, and solvent.

Soft magnetic alloy grains 1, 2 are mainly constituted by an alloy and exhibit soft magnetism. One example of the type of this alloy is a Fe-M-Si alloy (where M is a metal which is oxidized more easily than iron). M may be Cr, Al, etc., but preferably Cr. Soft magnetic alloy grains 1, 2 may be grains manufactured by the atomization method, for example.

If M is Cr, or specifically in the case of a Fe—Cr—Si alloy, the chromium content is preferably 2 to 15 percent by weight. Presence of chromium is preferred because it creates a passive state when heat-treated to prevent excessive oxidation, while expressing strength and insulation resistance. From the viewpoint of improving magnetic characteristics, on the other hand, it is preferable to minimize chromium. The above favorable range is proposed by considering the above.

In the case of a Fe—Cr—Si soft magnetic alloy, the Si content is preferably 0.5 to 7 percent by weight. Higher content of Si is preferable because it increases resistance and magnetic permeability, while lower content of Si is associated with good formability. The above favorable range is proposed by considering the above.

In the case of a Fe—Cr—Si alloy, the remainder other than Si and Cr is preferably Fe, except for unavoidable impurities. Metals that may be contained besides Fe, Si and Cr include aluminum, magnesium, calcium, titanium, manganese, cobalt, nickel, copper, etc., as well as such non-metals as phosphorous, sulfur and carbon.

The chemical composition of the alloy constituting the individual soft magnetic alloy grains 1, 2 in the laminated inductor 10 can be calculated by, for example, capturing a section of the laminated inductor 10 with a scanning electron microscope (SEM) and then applying the ZAF method based on energy dispersed X-ray spectroscopy (EDS).

As for the volume-based size of soft magnetic alloy grains, d50 is preferably in a range of 2 to 30 μm, d10 is preferably in a range of 1 to 5 μm, and d90 is preferably in a range of 4 to 30 μm. The values of d50, d10 and d90 of soft magnetic alloy grains are measured using a grain size/granularity distribution measuring apparatus based on the laser diffractive scattering method (such as Microtrack manufactured by Nikkiso Co., Ltd.). With a laminated inductor 10 using soft magnetic alloy grains, the grain size of soft magnetic alloy grains used as material grains has been shown to be roughly the same as the grain size of soft magnetic alloy grains 1, 2 constituting the magnetic body 12 of the laminated inductor 10.

The aforementioned magnetic paste preferably contains a polymer resin as binder. The type of this polymer resin is not specifically limited and may be polyvinyl butyral (PVB) or other polyvinyl acetal resin, for example. The type of solvent used for the magnetic paste is not specifically limited and butyl carbitol or other glycol ether may be used, for example. The blending ratio of soft magnetic alloy grains, polymer resin, solvent, etc., and other conditions of magnetic paste can be adjusted as deemed appropriate, and viscosity or other properties of magnetic paste can be set through such adjustments.

For the specific method to coat the magnetic paste and dry the coated film to obtain the green sheet, any prior art may be adopted as deemed appropriate.

In an embodiment of the present invention, a green sheet containing soft magnetic alloy grains is rolled. This rolling can be done using a calender roller, roll press, etc. By rolling, the surface side of soft magnetic alloy grains present on the green sheet surface can be flattened. Only the green sheet may be rolled or base film may be rolled together. Rolling is performed by, for example, applying a load of 1800 kgf or more, or preferably 2000 kgf or more, or more preferably 2000 to 8000 kgf, at temperatures of 60° C. or above, or preferably between 60 and 90° C.

More detailed rolling conditions include, but are not limited to, the following: (1) Upper/lower roll diameter of Ø100 mm, roll width of 165 mm; (2) sheet width of 30 to 120 mm; (3) feed rate of 0.1 to 3.5 m/min; (4) sheet thickness before rolling $T_1$ of 40 to 80 μm; (5) sheet thickness after rolling $T_2$ of 20 to 50 μm; (6) roll gap of 0 mm at rolling; and (7) roll ratio of 37.5 to 50%. The roll ratio is indicated by $(T_1-T_2)/T_1\times 100\%$. These conditions may be changed as deemed appropriate.

Next, a stamping machine, laser processing machine or other piercing machine is used to pierce the green sheet to form through holes in a specified layout. The through hole layout should be set in such a way that when the sheets are stacked on top of one another, the conductor-filled through holes and conductor patterns will form a conductor part 13. For the through hole layout and conductor pattern shape for forming the conductor part 13, any prior art may be used as deemed appropriate and specific examples will be explained in the example section later by referring to the drawings. If any shape other than a coil is formed for the conductor part 13, such as spiral coil, meandering conductive wire or straight conductive wire, each conductor pattern or through hole can be formed to fit the applicable shape.

Note that, although through holes are formed after rolling of the green sheet in the above explanation, the present invention also permits forming of through holes in the green sheet, followed by rolling of the sheet. Here, rolling and forming of through holes can be performed in any order, but preferably rolling is done before the printing of conductive paste explained later.

Preferably, conductive paste is used to fill the through holes and also to print conductor patterns. This conductive paste contains conductive grains, and typically a polymer resin as binder, and solvent.

For the conductive grains, silver grains, etc., can be used. As for the volume-based size of conductive grains, d50 is preferably in a range of 1 to 10 μm. The value of d50 of conductive grains is measured using a grain size/granularity distribution measuring apparatus based on the laser diffractive scattering method (such as Microtrack manufactured by Nikkiso Co., Ltd.).

The conductive paste preferably contains a polymer resin as binder. The type of polymer resin is not specifically limited and may be polyvinyl butyral (PVB) or other polyvinyl acetal resin, for example. The type of solvent used for the conductive paste is not specifically limited and butyl carbitol or other glycol ether may be used, for example. The blending ratio of conductive grains, polymer resin, solvent, etc., and other conditions of conductive paste can be adjusted as deemed appropriate, and viscosity or other properties of conductive paste can be set through such adjustments.

Next, a screen printer, gravure printer or other printing machine is used to print the conductive paste onto the surface of the green sheet and then the printed green sheet is dried with a hot-air dryer or other dryer to form conductor patterns corresponding to the shape of the conductor part 13. During this printing, some conductive paste is filled into the aforementioned through holes. As a result, the conductive paste filled in the through holes, and printed conductor patterns, constitute the conductor part 13.

The printed green sheets are stacked on top of one another in a specified order and then thermally pressure-bonded using a suction transfer machine and press machine to create a laminate. Next, a dicing machine, laser processing machine or other cutting machine is used to cut the laminate to the size of a main component body, to create a chip before heat treatment that contains the magnetic body and conductor part before heat treatment.

A baking furnace or other heating device is used to heat-treat the chip before heat treatment in atmosphere or other oxidizing ambience. This heat treatment normally includes a binder removal process and an oxide film forming process, where the binder removal process is implemented under conditions of approx. 300° C. for approx. 1 hour so that the polymer resin used as binder will vanish or be removed, while the oxide film forming process is implemented under conditions of approx. 750° C. for approx. 2 hours, for example.

In the chip before heat treatment, many fine voids are present between individual soft magnetic alloy grains and normally these fine voids are filled with a mixture of solvent and binder. These fillings disappear in the binder removal process, so when the binder removal process is complete, these fine voids have turned into pores. Also in the chip before heat treatment, many fine voids are present between conductive grains. These fine voids are also filled with a mixture of solvent and binder. These fillings also disappear in the binder removal process.

In the oxide film forming process following the binder removal process, soft magnetic alloy grains 1, 2 are aggregated closely together to form a magnetic body 12. When this happens, typically oxide film is formed on the surface of individual soft magnetic alloy grains 1, 2. At this time, conductive grains are sintered to form a conductor part 13. As a result, a laminated inductor 10 is obtained.

In the laminated inductor 10 thus obtained, the soft magnetic alloy grain 1 in an area where conductor patterns are printed has a distorted structure compared to the soft magnetic alloy grain 2 in other areas. To be specific, the soft magnetic alloy grain 1 in an area where conductor patterns are printed is flattened on the conductor pattern side (i.e., conductor part 13 side), and preferably, the conductor pattern side of soft magnetic alloy grain 1 is flattened over the entire plane including the aforementioned area where conductor patterns are printed.

Normally external terminals 14, 15 are formed after heat treatment. A dip coater, roller coater or other coating machine is used to coat a prepared conductive paste to both ends in the lengthwise direction of the main component body 11, and then the coated main component body is baked in a baking furnace or other heating device under conditions of approx. 600° C. for approx. 1 hour, for example, to form external terminals 14, 15. For the conductive paste for external terminals, the aforementioned paste for printing conductor patterns or any similar paste can be used as deemed appropriate.

The present invention is explained more specifically below using examples. Note, however, that the present invention is not at all limited to the embodiments described in these examples.

EXAMPLE 1

[Specific Structure of Laminated Inductor]

The specific structure of the laminated inductor 10 manufactured in this example is explained. As a component, the laminated inductor 10 has a length of approx. 3.2 mm, width of approx. 1.6 mm and height of approx. 0.8 mm, and its overall shape is rectangular solid. The laminated inductor 10 has a main component body 11 of rectangular solid shape and a pair of external terminals 14, 15 provided on both ends in the lengthwise direction of the main component body 11. FIG. 2 is a schematic section view of the laminated inductor. The main component body 11 has a magnetic body 12 of rectangular solid shape constituted by a laminate, and a coil 13 being a helical conductor part covered by the magnetic body 12, and both ends of the coil 13 are connected to the two opposing external terminals 14, 15, respectively.

Figure 3:
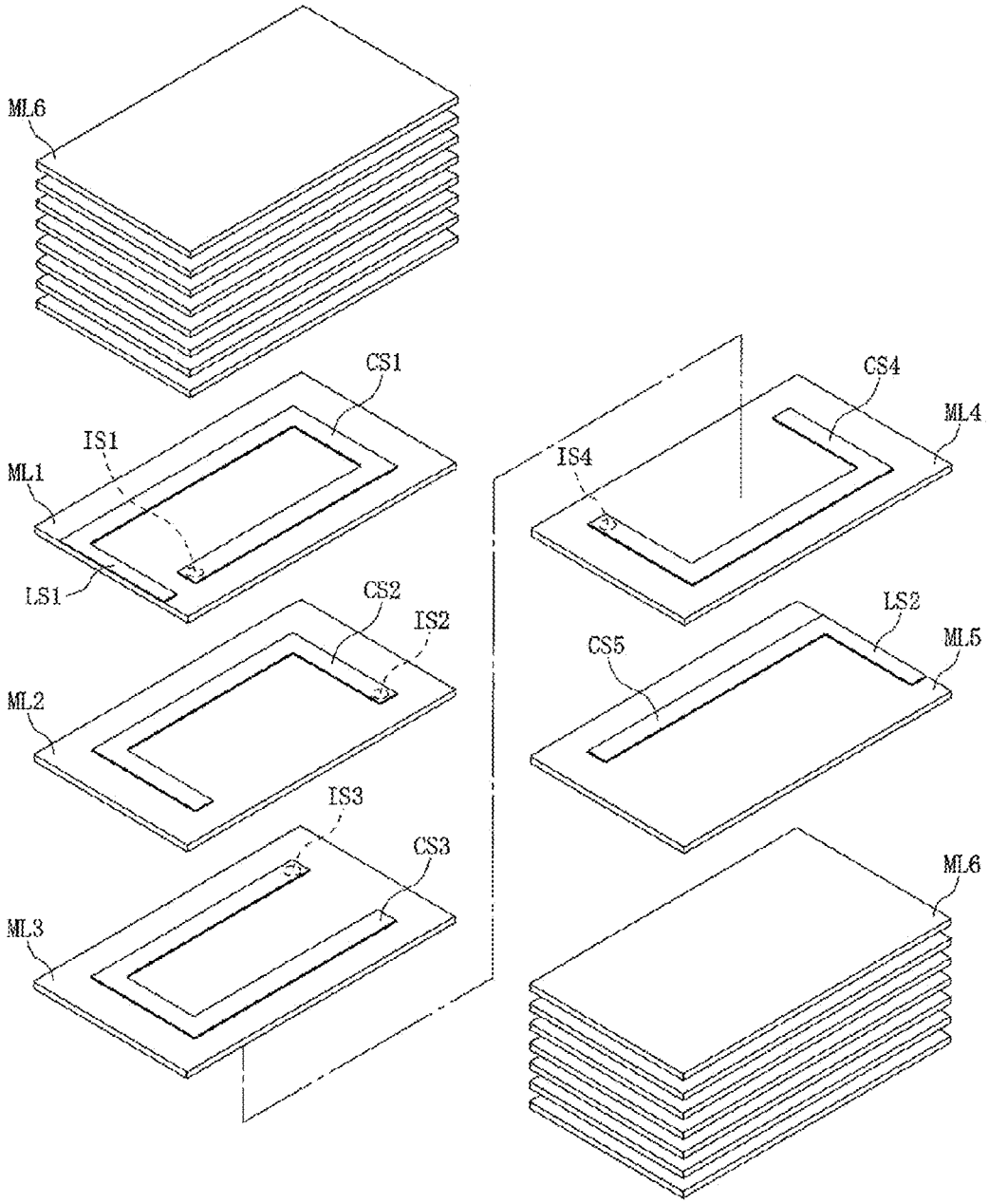
FIG. 3 is a schematic exploded view of a laminated inductor.

FIG. 3 is a schematic exploded view of the laminated inductor. The magnetic body 12 is structured in such a way that a total of 20 layers of magnetic layers ML1 to ML6 are put together, and has a length of approx. 3.2 mm, width of approx. 1.6 mm and height of approx. 0.8 mm. The length, width and thickness of each of the magnetic layers ML1 to ML6 are approx. 3.2 mm, approx. 1.6 mm and approx. 40 nm, respectively. This magnetic body 12 is formed mainly by Fe—Cr—Si alloy grains which are soft magnetic alloy grains. The magnetic body 12 does not contain glass component. The composition of Fe—Cr—Si alloy grains is 92 percent by weight of Fe, 4.5 percent by weight of Cr, and 3.5 percent by weight of Si. The d50, d10 and d90 of Fe—Cr—Si alloy grains are 10 μm, 3 μm and 16 μm, respectively. These d50, d10 and d90 are parameters expressing a volume-based grain size distribution. Also, the inventors confirmed via SEM observation (×3000) that oxide film (not illustrated) was present on the surface of individual Fe—Cr—Si alloy grains and that Fe—Cr—Si alloy grains in the magnetic body 12 were mutually bonding via oxide films on adjacent alloy gains. Additionally, the Fe—Cr—Si alloy grain 1 near the coil 13 is closely contacting the coil 13 via oxide film. This oxide film was confirmed to contain at least $Fe_3O_4$ which is a magnetic body, and $Fe_2O_3$ and $Cr_2O_3$ which are non-magnetic bodies.

The coil 13 is structured in such a way that a total of five coil segments CS1 to CS5 are helically integrated with a total of four relay segments IS1 to IS4 that connect the coil segments CS1 to CS5, and the number of windings is approx. 3.5. This coil 13 is primarily obtained by heat-treating silver grains, and the volume-based size d50 of material silver grains is 5 μm.

The four coil segments CS1 to CS4 have a C shape, while the one coil segment CS5 has a strip shape. The thickness of coil segments CS1 to CS5 is approx. 20 μm and their width is approx. 0.2 mm. The top coil segment CS1 has a continuously formed L-shaped leader part LS1 used for connecting the external terminal 14, while the bottom coil segment CS5 has a continuously formed L-shaped leader part LS2 used for connecting the external terminal 15. The relay segments IS1 to IS4 are column-shaped in a manner piercing through the magnetic layers ML1 to ML4, and the bore size of each column is approx. 15 μm.

The external terminals 14, 15 cover the end faces in the lengthwise direction of the main component body 11, as well as four side faces near these end faces, and their thickness is approx. 20 μm. The one external terminal 14 connects to the edge of the leader part LS1 of the top coil segment CS1, while the other external terminal 15 connects to the edge of the leader part LS2 of the bottom coil segment CS5. These external terminals 14, 15 were obtained primarily by heat-treating silver grains whose volume-based size d50 was 5 μm.

[Manufacturing of Laminated Inductor]

Magnetic paste was prepared which was constituted by 85 percent by weight of the aforementioned Fe—Cr—Si alloy, 13 percent by weight of butyl carbitol (solvent) and 2 percent by weight of polyvinyl butyral (binder). A doctor blade was used to coat this magnetic paste onto the surface of a plastic base film which was then dried with a hot-air dryer under conditions of approx. 80° C. for approx. 5 minutes to obtain a green sheet on base film. This green sheet was rolled alone, or with the base film, using a calender roll at approx. 70° C. with a load of 2000 kgf. At this time, the following conditions were used: (1) Upper/lower roll diameter of Ø100 mm, roll width of 165 mm; (2) sheet width of 120 mm; (3) feed rate of 0.1 m/min; (4) sheet thickness before rolling $T_1$ of 40 μm; (5) sheet thickness after rolling $T_2$ of 25 μm; (6) roll gap of 0 mm at rolling; and (7) roll ratio of 37.5%. Thereafter, the green sheet was cut to obtain first through sixth sheets corresponding to the magnetic layers ML1 to ML6 (refer to FIG. 3) and having a size appropriate for multi-part production.

Next, a piercing machine was used to pierce the first sheet corresponding to the magnetic layer ML1 to form through holes in a specified layout in a manner corresponding to the relay segment IS1. Similarly, through holes were formed in a specified layout in the second through fourth sheets corresponding to the magnetic layers ML2 to ML4, respectively, in a manner corresponding to the relay segments IS2 to IS4.

Next, conductive paste constituted by 85 percent by weight of the aforementioned silver grains, 13 percent by weight of butyl carbitol (solvent) and 2 percent by weight of polyvinyl butyral (binder) was printed with a printing machine onto the surface of the first sheet which was then dried with a hot-air dryer under conditions of approx. 80° C. for approx. 5 minutes to create a first printed layer in a specified layout in a manner corresponding to the coil segment CS1. Similarly, second through fifth printed layers were created in a specified layout on the surfaces of the second to fifth sheets, respectively, in a manner corresponding to the coil segments CS2 to CS5.

Since the through holes formed in the first through fourth sheets were positioned in a manner overlapping the ends of first through fourth printed layers, respectively, some conductive paste was filled in these through holes when the first through fourth printed layers were printed, to form first through fourth filled parts corresponding to the relay segments IS1 to IS4.

Next, a suction transfer machine and press machine were used to stack the sheets on top of one another in the order shown in FIG. 3 and thermally pressure-bond the first through fourth sheets having both a printed layer and filled part, fifth sheet having only a printed layer, and sixth sheet without printed layer or filled part, to create a laminate. This laminate was cut to the size of a main component body using a cutting machine to obtain a chip before heat treatment.

Next, multiple chips before heat treatment were heat-treated together in atmosphere using a baking furnace. They were first heated under conditions of approx. 300° C. for approx. 1 hour in the binder removal process, and then heated under conditions of approx. 750° C. for approx. 2 hours in the oxide film forming process. As a result of this heat treatment, soft magnetic alloy grains were aggregated closely together to form a magnetic body 12, while silver grains were sintered to form a coil 13, and as a result a main component body 11 was obtained.

Next, external terminals 14, 15 were formed. The aforementioned conductive paste constituted by 85 percent by weight of silver grains, 13 percent by weight of butyl carbitol (solvent) and 2 percent by weight of polyvinyl butyral (binder) was coated with a coater to both ends in the lengthwise direction of the main component body 11, and the coated main component body was baked in a baking furnace under conditions of approx. 600° C. for approx. 1 hour. As a result, solvent and binder disappeared, silver grains were sintered, and external terminals 14, 15 were formed, and a laminated inductor was obtained.

COMPARATIVE EXAMPLE 1

A laminated inductor was obtained using the same materials and processes as described in Example 1, except that the formed green sheets were not rolled using a calender roll.

EXAMPLE 2

A laminated inductor was obtained in the same manner as described in Example 1, except that Fe—Si—Al alloy grains constituted by 85 percent by weight of Fe, 9 percent by weight of Si and 6 percent by weight of Al (d50=30 μm, d10=10 μm, d90=100 μm) were used as soft magnetic grains instead of Fe—Cr—Si alloy grains.

COMPARATIVE EXAMPLE 2

A laminated inductor was obtained using the same materials and processes as described in Example 2, except that the formed green sheets were not rolled using a calender roll.

[Shape Evaluation of Soft Magnetic Alloy Grains]

Figure 4:
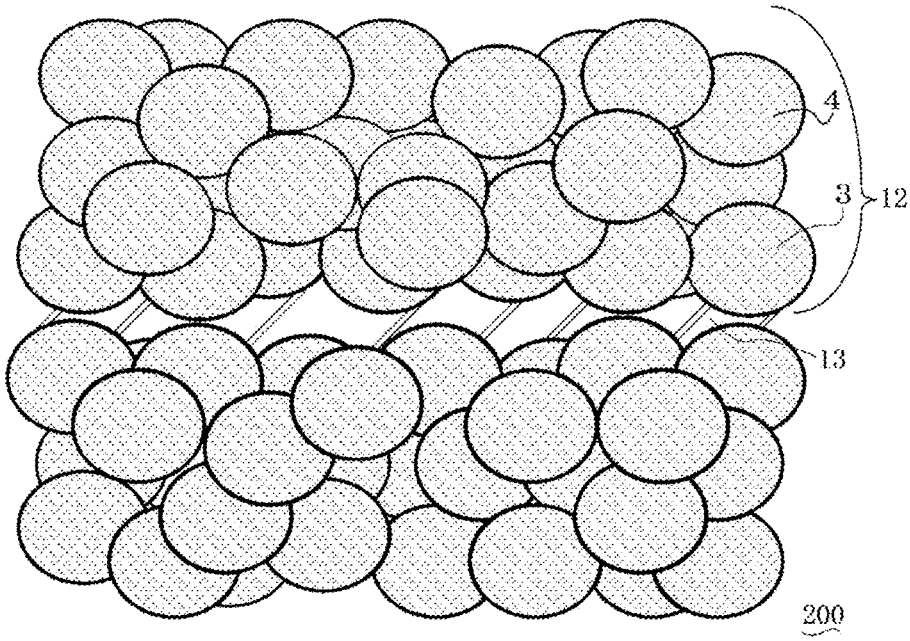
FIG. 4 is a schematic section view of a partial structure near a conductor part in a comparative example.

A section of the obtained laminated inductor was observed in a ×2000 SEM image. In Examples 1 and 2, it was confirmed that soft magnetic alloy grains contacting the coil were flattened toward the coil 13, as shown in FIG. 1. It was confirmed that, at the layer interfaces, soft magnetic alloy grains not contacting the coil 13 were also flattened on the interface side (i.e., both main surfaces of each layer), and consequently the layer interfaces constituted smooth surfaces. In Comparative Examples 1 and 2, on the other hand, the aforementioned flattening of soft magnetic alloy grains was not confirmed. FIG. 4 is a schematic section view of a partial structure near the coil in a comparative example. In this partial structure 200, it is shown that a soft magnetic alloy grain 3 contacting the coil 13 is not flattened toward the coil 13 when compared to a soft magnetic alloy grain 4 not contacting the coil 13.

[Micro Evaluation of Soft Magnetic Alloy Grains]

With the laminated inductors obtained in all examples and comparative examples, bonding of soft magnetic alloy grains via oxide films was confirmed by a SEM (×3000).

[Wire Breakage Evaluation of Coil]

A total of 100 samples of obtained laminated inductors were used to conduct a DC resistance evaluation test to evaluate the vulnerability of the coils to wire breakage. Each obtained laminated inductor was judged broken when its DC resistance was 300 mΩ or more. This is because normally the DC resistance of a coil is 100 mΩ or less if not broken, but it rises to 1Ω or more if the coil is broken.

In the above test, samples whose breakage ratio was less than 1%, 1% or more but less than 10%, and 10% or more, were rated A, B and C, respectively.

Table 1 summarizes the manufacturing conditions and evaluation results corresponding to the examples and comparative examples.

TABLE 1

| | Soft magnetic alloy | Rolling conditions | Wire breakage evaluation | Magnetic permeability |
|---|---|---|---|---|
| Example 1 | Fe—Cr—Si | Pressure: 2000 kgf Temperature: Approx. 70° C. | A | 20 |
| Example 2 | Fe—Si—Al | Pressure: 2000 kgf Temperature: Approx. 70° C. | B | 16 |
| Comparative Example 1 | Fe—Cr—Si | None | C | 15 |
| Comparative Example 2 | Fe—Si—Al | None | C | 15 |

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein.

The present application claims priority to Japanese Patent Application No. 2011-173907, filed Aug. 9, 2011, the disclosure of which is incorporated herein by reference in its entirety. In some embodiments, as the magnetic body, those disclosed in co-assigned U.S. patent application Ser. Nos. 13/092,381, 13/277,018, and 13/313,999 can be used, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A laminated inductor comprising a magnetic body, a conductor part in contact with and enclosed by the magnetic body, and external terminals provided on the outside of the magnetic body and conducting to the conductor part;

wherein the magnetic body is a laminate constituted by layers containing soft magnetic alloy grains, and in the magnetic body, more than half of the soft magnetic alloy grains contacting the conductor part are non-randomly deformed and flattened so that the flattened surfaces of the soft magnetic alloy grains define substantially a common plane to contact the conductor part as compared with the shapes of soft magnetic alloy grains located away from the conductor part.

2. A laminated inductor according to claim 1, wherein the soft magnetic alloy grains positioned on main surfaces of the layers containing soft magnetic alloy grains are flattened on the main surfaces, said main surfaces of each layer being surfaces extending perpendicular to a thickness direction of the layer.

3. A laminated inductor according to claim 1, wherein the soft magnetic alloy grains are constituted by a Fe—Cr—Si alloy.

4. A laminated inductor according to claim 2, wherein the soft magnetic alloy grains are constituted by a Fe—Cr—Si alloy.

5. A laminated inductor according to claim 1, wherein the soft magnetic alloy grains have an oxide film on their surface bonding the soft magnetic alloy grains.

6. A laminated inductor according to claim 2, wherein the soft magnetic alloy grains have an oxide film on their surface bonding the soft magnetic alloy grains.

7. A laminated inductor according to claim 3, wherein the soft magnetic alloy grains have an oxide film on their surface bonding the soft magnetic alloy grains.

8. A laminated inductor according to claim 4, wherein the soft magnetic alloy grains have an oxide film on their surface bonding the soft magnetic alloy grains.

9. A laminated inductor comprising a magnetic body, a conductor part in contact with and enclosed by the magnetic body, and external terminals provided on the outside of the magnetic body and conducting to the conductor part;

wherein the magnetic body is a laminate constituted by layers containing soft magnetic alloy grains, and in the magnetic body, at least some soft magnetic alloy grains contacting the conductor part undergo methodical or systematic deformation to be flattened to contact the conductor part as compared with the shapes of soft magnetic alloy grains located away from the conductor part, wherein the soft magnetic alloy grains have an oxide film on their surface bonding the soft magnetic alloy grains.

10. A laminated inductor according to claim 9, wherein the soft magnetic alloy grains positioned on main surfaces of the layers containing soft magnetic alloy grains are flattened on the main surfaces, said main surfaces of each layer being surfaces extending perpendicular to a thickness direction of the layer.

11. A laminated inductor according to claim 9, wherein the soft magnetic alloy grains are constituted by a Fe—Cr—Si alloy.

* * * * *